US007799173B2

(12) United States Patent
Sheerer et al.

(10) Patent No.: US 7,799,173 B2
(45) Date of Patent: Sep. 21, 2010

(54) SCREEN PLATES HAVING DIAGONAL SLOTS WITH CURVED INLETS FOR A DIGESTER

(75) Inventors: Jay K. Sheerer, Queensbury, NY (US); Carl Luhrmann, Glens Falls, NY (US)

(73) Assignee: Andritz Inc., Glens Falls, NY (US)

( * ) Notice: Subject to any disclaimer, the term of this patent is extended or adjusted under 35 U.S.C. 154(b) by 150 days.

(21) Appl. No.: 11/953,098

(22) Filed: Dec. 10, 2007

(65) Prior Publication Data

US 2008/0173415 A1 Jul. 24, 2008

Related U.S. Application Data

(60) Provisional application No. 60/880,959, filed on Jan. 18, 2007.

(51) Int. Cl.
*D21C 7/06* (2006.01)

(52) U.S. Cl. ..... 162/246; 162/251; 162/380; 210/498; 209/397

(58) Field of Classification Search ..... 162/251, 162/246, 380; 210/498, 499, 415, 485; 209/397
See application file for complete search history.

(56) References Cited

U.S. PATENT DOCUMENTS

| | | | | | |
|---|---|---|---|---|---|
| 4,193,503 | A * | 3/1980 | Connolly | 209/393 |
| 4,986,900 | A * | 1/1991 | Mason | 209/397 |
| 5,090,721 | A * | 2/1992 | Lange | 220/485 |
| 5,255,790 | A * | 10/1993 | Einoder et al. | 209/393 |
| 5,472,095 | A * | 12/1995 | Malm | 209/303 |
| 5,638,960 | A * | 6/1997 | Beuermann et al. | 209/397 |
| 5,791,495 | A * | 8/1998 | Gero et al. | 209/395 |
| 6,165,323 | A * | 12/2000 | Shearer | 162/251 |
| 6,595,373 | B1 * | 7/2003 | Seifert | 210/488 |
| 7,115,189 | B2 * | 10/2006 | Baker | 162/251 |
| 7,125,472 | B2 * | 10/2006 | Baker | 162/251 |

* cited by examiner

*Primary Examiner*—Mark Halpern
(74) *Attorney, Agent, or Firm*—Nixon & Vanderhye P.C.

(57) ABSTRACT

A screen plate for a cellulosic material puling vessel, the screen plate including: slots having curved inlet corner edges adjacent an inside surface of the screen plate and facing a pulp flow.

36 Claims, 6 Drawing Sheets

SCREEN PLATES HAVING DIAGONAL SLOTS WITH CURVED INLETS FOR A DIGESTER

BACKGROUND OF THE INVENTION

This application claims the benefit of U.S. Provisional Patent Application Ser. No. 60/880,959 filed Jan. 18, 2007, the entirety of which is incorporated by reference.

The present application is generally directed to making pulp and is more specifically directed to screen assemblies for pulp digesters.

Wood chips and other cellulosic fibrous material are treated in digesters to chemically separate fibers in the chips and material by, for example, removing lignins. A digester is a vessel in which wood chips are treated with heat, liquid, and chemicals to convert the chips to pulp. A continuous digester vessel is typically an upright cylinder with an upper inlet to receive chips in a continuous flow. The chips flow slowly through the digester vessel, 100 to 300 feet tall (30 to 100 meters) in a generally downward direction.

As the chips move through the continuous digester, the lignins binding fibers together in the chips release the fibers and the chips are converted to pulp. The pulp is removed through a bottom outlet of the digester. Chips are continually added to a continuous digester while the chips already in the digester vessel are processed and pulp is discharged from the bottom of the vessel. In a batch digester, chips are first loaded in a vessel, the loaded chips are processed as a batch and thereafter the processed chips are discharged to empty the vessel. In a batch digester the chips tend to remain in substantially the same location in the vessel.

Chemicals, e.g., cooking liquor, in a digester process the chips, cause lignins to unbind fibers and convert the chips to pulp. The chemicals are included in cooking liquor that is continuously pumped into and out of batch and continuous digesters. Screen plates are used in conventional digesters for the production of chemical cellulose pulp, e.g. kraft pulp, for both continuous and batch digesters. Screen plates are filters that allow liquor to be extracted from a digester but prevent the extraction of fibrous material. Screen plates are generally arranged around an inner circumference of a digester. An inner surface of the plate is exposed to the chip slurry in the digester and an outer surface of the plate forms a wall to a liquor extraction chamber. The screen plate may have multiple rows of narrow slots through which liquor (but not fiber) is extracted from the chip slurry and flows into the extraction chamber.

The slots in screen plates tend to clog or plug with fibers and have been a source of a decrease in pulp process quality. Various types of slot designs have been developed to reduce the tendency of clogging and plugging. For example, orienting the slots diagonally to the vertical axis and horizontal planes of the digester has been found to reduce clogging and plugging of slots. See U.S. Pat. No. 6,165,323. However, clogging and plugging of the diagonal slots still occurs and there continues to be a long felt need for devices that further reduce the tendency of slot clogging and plugging.

A concern has arisen that chips in a digester clog the slots of a digester screen. Slots are narrow to block chips from being withdrawn from a digester along with the cooking liquor. While narrow, there is a risk that chips become logged in slots. This risk is relatively large with vertical slots in a continuous digester where chips move in the same direction of the slots. This risk is decreased with diagonal slots in which chips move vertically and at an angle with respect to the slots.

As chips move across the diagonal slots, the chips may catch on the slots and clog the slots.

There is a long felt need for slots, especially diagonal slots, in a screen plate that have reduced risk of being clogged or plugged by chips. The need arises from the difficulties that occur when chips clog slots and prevent the flow of cooking liquor through the screen and out of the digester. While the need is greatest with respect to continuous digesters, there is also a need for clog free slots in screen plates for batch digesters, especially for diagonal screen plates.

BRIEF DESCRIPTION OF THE INVENTION

A novel screen plate has been developed comprising slots having curved inlet edges to minimize chips begin caught on the edges and deflect chips into the pulp flow. The curved inlet slot edges are adjacent an inside surface of the screen plate and face the pulp flow. The curved inlet slot edges may be rounded, sloped or inclined. For example, inlets may have a generous radius of curvature equal to one third to two thirds the thickness of the plate. The curved inlets may be only on the lower side surface of a slot or on the upper and lower slot side surfaces. A curved inlet only on the lower side surface is suitable for a continuous digester in which the pulp flow is generally downward and chips tend to impinge on the inlet edge of the lower sides of slots. Curved inlets on both the upper and lower side surfaces of slots is suitable for both continuous and batch digesters. In addition, the lower side surface of the slot may be horizontal in cross-section or be inclined upward from the inside surface of the plate to the outer surface. Such a horizontal or upwardly inclined lower slot surface tends to deflect chips in the slot out of the slot and into the pulp stream.

A screen plate for a cellulosic material puling vessel, the screen plate including: slots having curved inlet corner edges adjacent an inside surface of the screen plate and facing a pulp flow.

A screen plate assembly has been developed for a continuous digester vessel for pulping cellulosic material, the assembly comprising: a plurality of screen plates for a cellulosic material puling vessel, each plate having a arc shape in cross-section, and said screen plates being assembled to form an annulus attached to an inside surface of the digester vessel, and each screen plate including slots having curved inlet corner edges adjacent an inside surface of the screen plate and facing a pulp flow.

A method has been developed for extracting a liquid from a continuous digester vessel, the method comprising: processing cellulosic material and a liquid in the vessel, wherein the cellulosic material flows through the vessel until the material is discharged from a discharge output of the vessel; extracting a portion of the liquid through a screen plate assembly, wherein the screen plates are assembled to form an annulus attached to an inside surface of the digester vessel, and each screen plate includes slots having curved inlet corner edges adjacent an inside surface of the screen plate and facing a pulp flow, and deflecting cellulosic material flowing through the vessel with the curved inlet corner edges to avoid the material become caught in the slots.

DETAILED DESCRIPTION OF THE INVENTION

Figure 1:
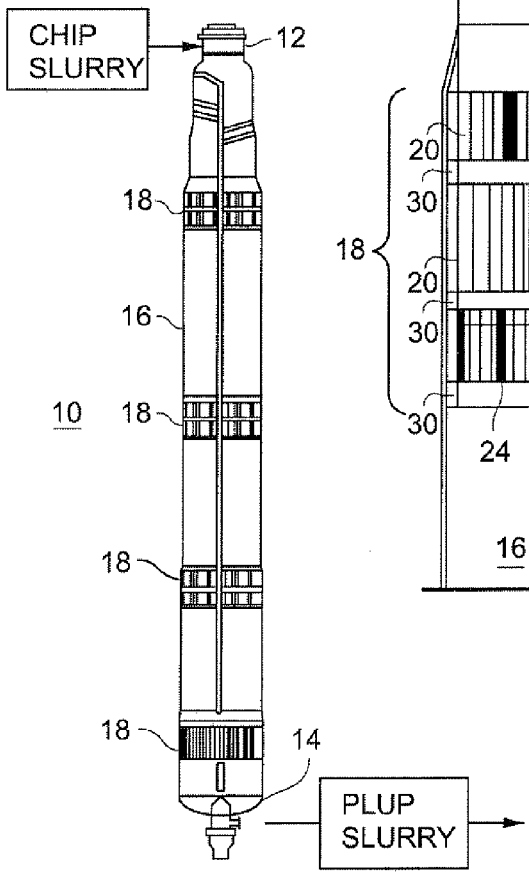
FIGURE 1 (Prior Art)
FIG. 1 is a front view of a conventional continuous digester shown schematically and partially cut away.

FIG. 1 is a side view of a continuous vertical digester 10 for processing cellulosic fiber material, e.g., wood chips, into fiber pulp. Though a vertical continuous digester is shown, the screen plates and screen slots described herein are applicable to other types of cylindrical continuous and batch digesters. While the novel screen plates disclosed herein are shown in the context of a continuous digester, the screen plates are applicable to batch digesters.

A slurry of comminuted cellulosic fibrous material and cooking chemical is introduced at the top 12 of the digester and a slurry of fully-cooked pulp and spent cooking liquor is discharged at the bottom 14. The digester 10 comprises a cylindrical shell 16 that typically forms a column of, for example, 100 feet (30 meters) tall. Within the cylindrical shell are several cylindrical screen assemblies 18.

Figure 2:
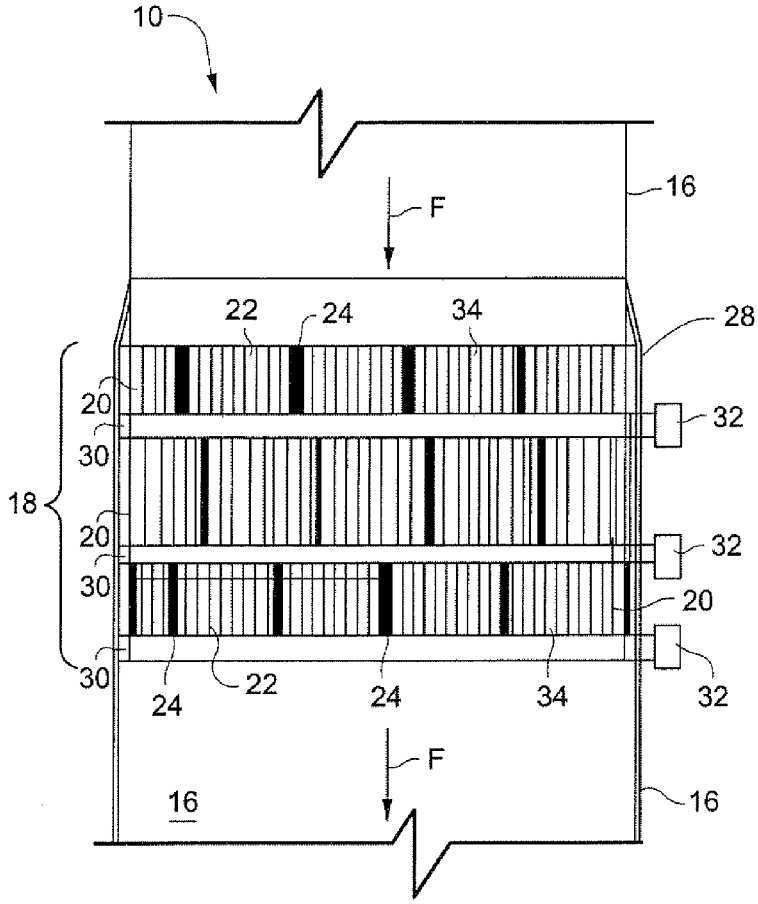
FIGURE 2 (Prior Art)
FIG. 2 is a front view of a conventional inner screening assembly and wall of the digester shown schematically.

FIG. 2 is an inside view of a screen assembly 18 having an multiple elevations of cylindrical screen sections 20. The screens may include screen plates 22 assembled to form the cylindrical screen section. The screen plates are attached to a frame 24 on the inner wall of shell 16. The frame 24, for example, comprises metal bars, angle irons, or like structural elements which are connected directly to the digester outer shell 16, although the frame 24 may be distinct and detachable from the digester. Each screen section forms generally an annular ring around the inside wall of the cylindrical shell 16 of the digester 10.

Figure 3:
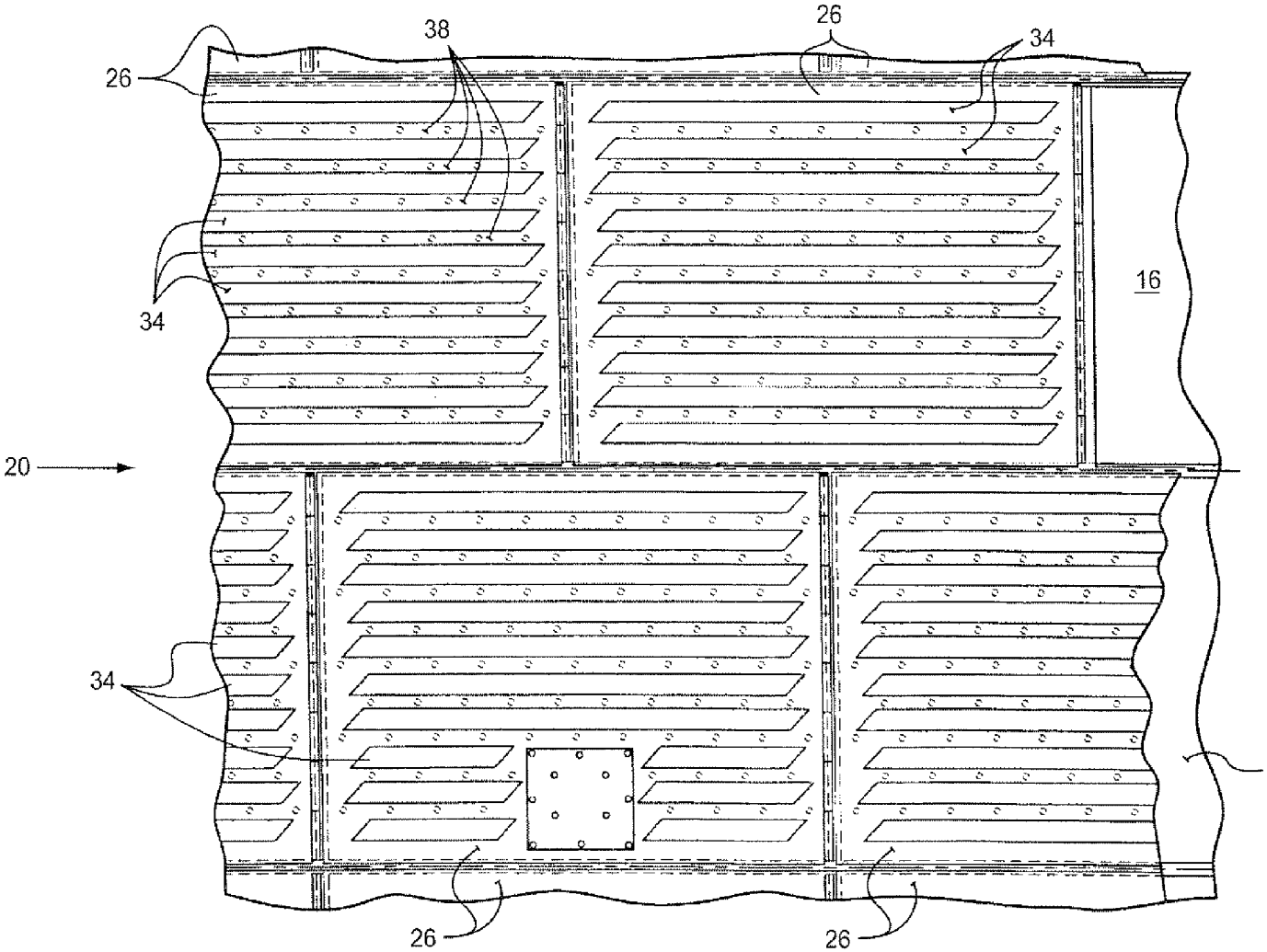
FIGURE 3 (Prior Art)
FIG. 3 is a front view of several assembled screen plates in a conventional screening assembly.

FIG. 3 is a schematic diagram of a portion of a screen section 20 in a screen assembly 18. The section includes an array of metal screen plates 26. Each plate has rows of trapezoidal screen slot regions 34 (shown schematically in FIG. 3). These slot regions define rows of screen slots, such as the slot rows 34 shown in FIGS. 4 and 5. Between the slot regions 34 on a screen plate are land areas 38 that are parallel to the slot regions.

The slot regions 34 are shown as horizontal rows in FIG. 3 and as vertical columns in FIG. 2. The orientation of the slot regions may vary from digester to digester; from screen assembly to assembly in a single digester; from screen section to screen section, and from slot region to slot region in a single screen section or screen plate. While the slot regions 34 are generally oriented vertically or horizontally, they may also be arranged on a diagonal with respect to the digester.

The screen plates have narrow slots or apertures (collectively referred to as slots) that extend through the thickness of the plate 26 and allow liquor, but not fibers, to pass through the plates. The slots may be arranged in various orientations such as vertically, horizontally, or at an oblique angle, such as at a 45-degree angle from the vertical. Diagonal slots have been found to be more resistant to becoming clogged/plugged with fibers, that are vertical and horizontal slots.

An annular chamber 28 for collecting the liquor is generally behind each screen assembly 18. Liquor is withdrawn through each screen from the flow (F) of the pulp slurry moving generally downwardly through the digester. Beneath each annular chamber 28 are generally smaller annular cavities 30, commonly referred to as "internal headers", for collecting the liquor from the chambers 28. Liquor collected in the cavities 30 is discharge through liquor removal conduits 32. Though these chambers and cavities are shown as being located internal to the shell 16, they may also be located external to the shell, that is, "external headers" may be used.

The screen assembly 18 is shown as having a continuous cylindrical screen surface formed of a screen plate 26, where the plate has sections, e.g., rows, of screen slots. However, the screen surface may not be continuous or cylindrical. For example, the screen surface may also comprise multiple individual circular screens, or the screen surface may comprise alternating screen surfaces and blank plates, commonly referred to as a "checker board pattern". More than one such screen assembly 18 can be used in the same digester vessel 10. Further, the screen assembly may be tapered such that the diameter of the bottom of the screen assembly may be greater than the diameter at the top. Tapered screen assemblies may be used to span a region of increasing diameter in the digester vessel.

Each screen assembly 18 is shown as having a screen sections with multiple screen plates, for example three elevations, e.g., upper, middle and lower. The number of screen plates 26 in each section 20 and assembly 18 may vary from assembly to assembly in a single digester, and from digester to digester. The width of the slots in the screen plate can be, for example, in a range of 3 mm to 9 mm. Further, the slot shape, sizing and orientation in each section 20 screen plates may vary. For example, the width of slots in the upper section may be approximately 3 mm to 4 mm, which may be narrower than the width of the slots in the middle section, e.g. approximately 4-5 mm. Similarly, the width of slots in the middle section may be narrower than the width of slots in the lower section, e.g. approximately 5-6 mm. By using slots of increasing width at lower screen in a screen assembly 18 is believed to reduce the tendency of the slots to clog with fibers from the pulp slurry. Moreover, the length of the slots in a screen plate may be uniform, even from one section to another section.

Figure 4:
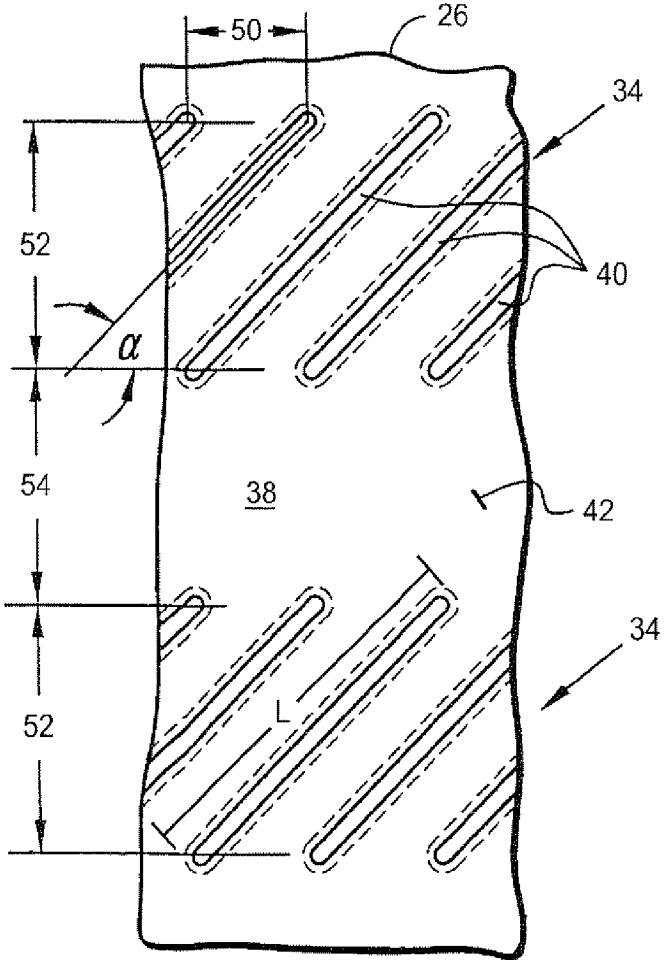
FIGURE 4 (Prior Art)

As shown in FIG. 4, the slots regions 34 shown in the screen plate 38 are diagonal and form an angle ($\alpha$) with respect to horizontal. The orientation of the slots may vary from digester to digester; from screen assembly to assembly in a single digester; from screen section to screen section, and from row to row of slots in a single screen or screen plate.

Figure 5:
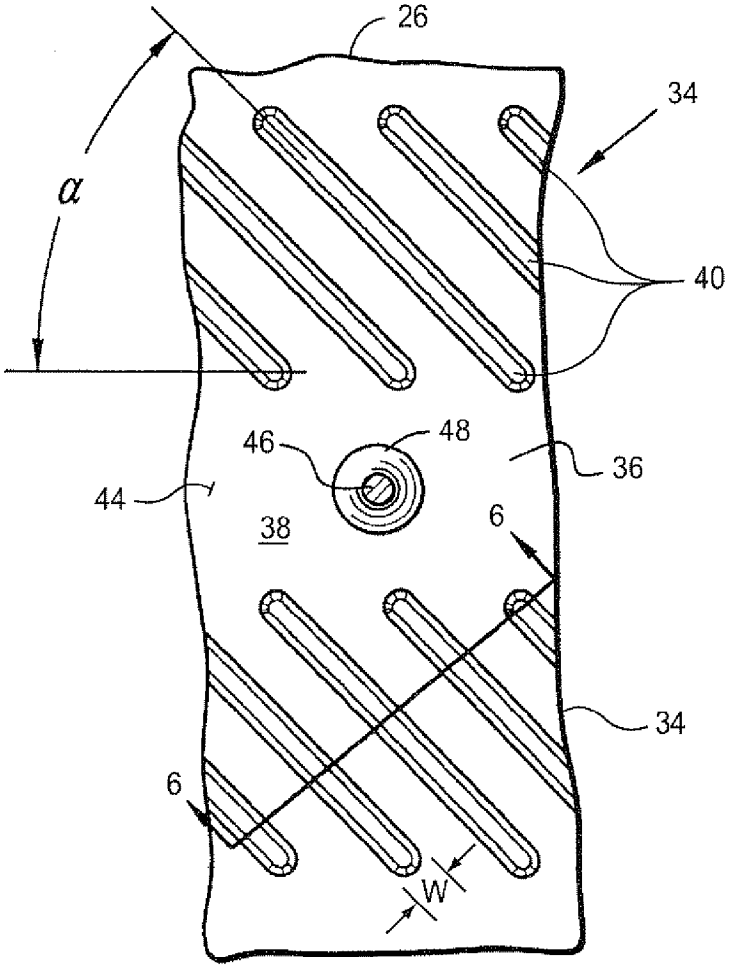
FIGURE 5 (Prior Art)
FIGS. 4 and 5 are front and back views, respectively, of a portion of a conventional screen plate.

Individual machined slots 40 generally form a horizontal row that comprise a slot region 34. FIG. 4 shows an outer surface 42 of the screen plate 26, where the outer surface faces the liquor chamber 30. FIG. 5 shows an inner surface 44 of the screen plate 26, where the inner surface faces the chip slurry in the digester vessel. The screen plates are secured to the frame 28 by pins 46 that extend through pin holes 48 in the plate. Several pin and pin holes may be used to secure each screen plate 26 to the frame 28.

Each of the schematically illustrated slots 40 are diagonal and are oriented at an angle alpha $\alpha$ with respect to the vertical axis or a horizontal plane of the digester vessel. While slots may be aligned vertically or horizontally with respect to the pulp flow (F) direction, diagonal slots are less prone to clogging/plugging. The slot angle $\alpha$ (FIG. 4) may be between 30 to 60 degrees, and is preferably about 45 degrees. The slot angle is the angle formed by the axis of the slot parallel to the plate with respect to a vertical axis of the vessel.

Each of the slots 40 is spaced from an adjacent slot by a horizontal distance 50 of about one inch, e.g., between 0.75-1.5 inches. Each of the slot regions 34 has a vertical dimension 52 of between 1.5 to three times the distance 50 between adjacent slots 40.

The land areas 38 have a vertical dimension 54, which preferably is approximately equal to the slot 40 vertical dimension 52, e.g. about two inches. Preferably the slot vertical (or horizontal) dimension 52 for each of the slot region (row) 34 and the vertical (or horizontal) dimension 54 for the land areas 38 are substantially the same in any particular screen plate, although under some circumstances they may vary. Also, preferably the slot angle at is the same for all the slots 40 from one slot region 34 to the next in a screen plate, although again there may be variations from region to region. Also preferably all of the slot regions 34 within a given screen plate 26 have the same orientation, but from one screen plate 26 to the next, vertically, the slots 40 may have opposite orientations (that is for one screen plate the slots 40 may slant up left to right from top to bottom, and the other right to left from top to bottom).

Figure 6:
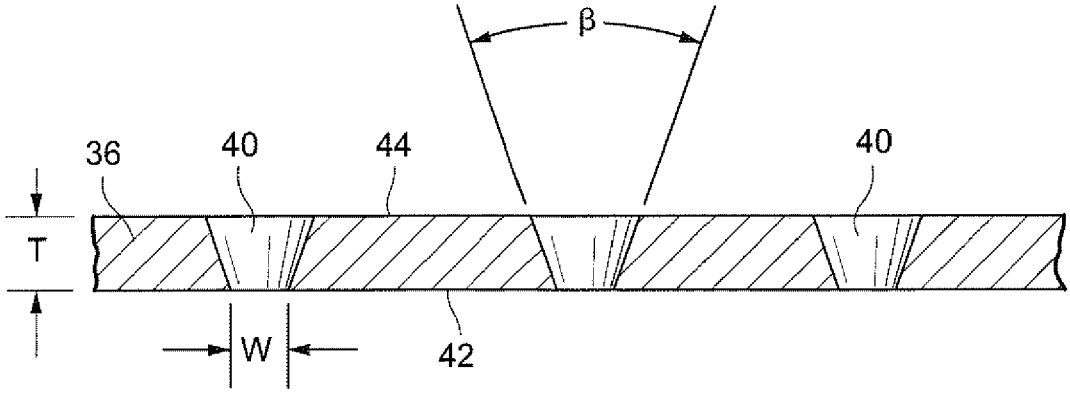
FIGURE 6 (Prior Art)
FIG. 6 is a partial cross-section of a conventional screen plate taken along line 6-6 in FIG. 5.

As shown in FIG. 6, the slots 40 in each slot region 34 have a narrow opening at the inner surface 44 of the plate 36 and a wide opening at the outer surface 42 of the plate. The width (W) of a slot may be taken the narrow dimension of the slot, as compared to the length (L) of the slot (as shown in FIG. 4). The thickness (T) of the slot is the thickness of the plate 36. If the slot is tapered along its thickness (T), the angle of the taper may be beta (β) (FIG. 6), e.g., 30 degrees. In a specific embodiment, the width (W) may be measured at the narrowest opening of the slot, such as at the outer surface 42 of the plate 36. Generally, all slots 40 in a slot region 34 (and even in a screen plate) have uniform widths (W), lengths (L), thicknesses (T) and tapers (β). However, the slot width (W) may vary from slot region to region, from screen plate to plate, and/or from screen section to screen section within a screen assembly.

Figure 8:
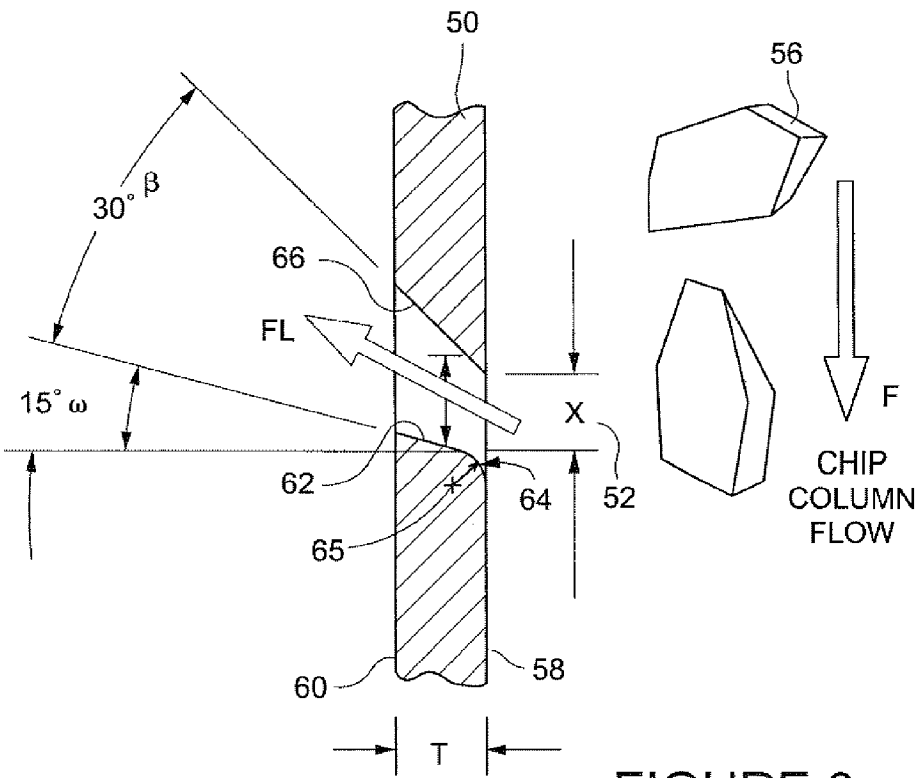
FIG. 8 a cross-sectional side view of the first embodiment of a screen plate, where the view is taken along line 8-8 in FIG. 7.
Figure 7:
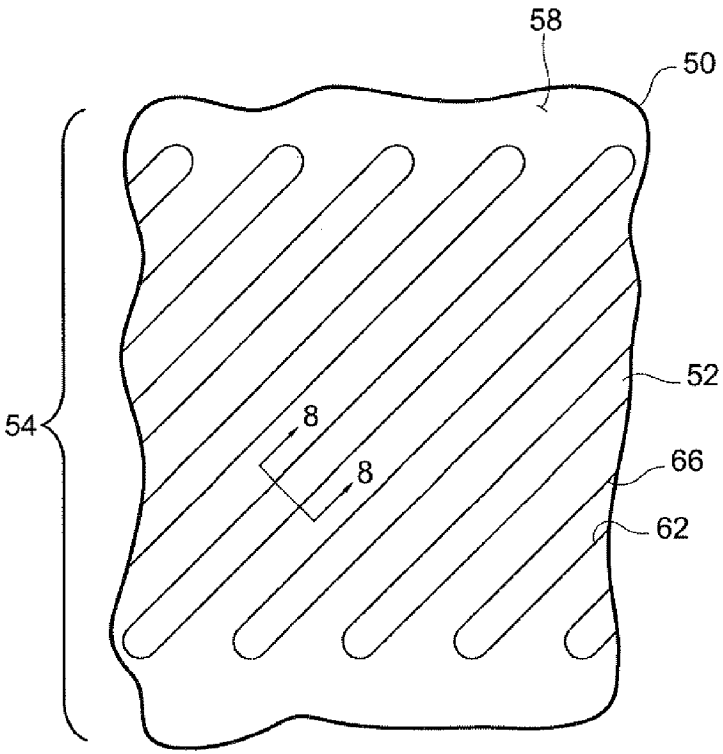
FIG. 7 is a front view of a first embodiment of a screen plate having diagonal slots with curved, e.g., rounded, inlet edges.

FIGS. 7 and 8 are a front and a cross-sectional side views, respectively, of a first embodiment of a screen plate 50 having diagonal slots with rounded inlet edges. The screen plate shown in FIGS. 7 and 8 are most suitable for continuous digesters in which the pulp slurry moves past the slots in a downward direction. The plate 50 may also be applied in a batch digester. The slots 52 are diagonal and arranged in rows of slot regions 54. Chips 56 in a pulp slurry flow in a direction (F) generally downward in a continuous digester and may be generally stationary in a batch digester. An inside surface 58 of the plate faces the flow (F) of chip and an outside surface 60 faces the liquor collection chambers. The width (X) of the slots at their throat is the narrowest section of the slot. The width (X) may be, for example, 2 to 9 millimeters.

A lower side 62 of each slot extends the length of the slot and is on the downstream side of the slot with respect to the flow (F) direction. The lower side has a curved inlet 64 which may be, for example, rounded, angled, sloped, chamfered, beveled and slanted. The curved inlet 64 is less susceptible to catching chips 56 in the pulp flow (F). Sharp inlet edges, especially the edges of the lower side of slots, found on prior art slots are more likely to catch chips and thus allow chips to clog the slot. The curved inlet 64 on the slot shown in FIGS. 7 and 8, and especially on the lower side of the slot, tends to deflect chips back into the flow (F) and away from the slot.

The curvature of the slot inlet may be defined by a radius of the curvature. The radius may be, for example, one-third to two-third of the thickness (T) of the plate. In view of the curved inlet, the narrowest region of the slot (X) may be inward of the inlet 64. The narrowest region may be a throat just beyond the inlet and between the inner surface 58 and outer surface 60 of the plate.

The lower side surface 64 of each slot 52 may form an inclination angle (ω) of between zero to 15 degrees, and preferably 5 to 15 degrees, with respect to horizontal. This inclination angle causes the cross-section of the lower side surface to be parallel to horizontal or have an upward incline with respect to the inside surface 58 of the plate. The lower side surface with a horizontal or inclined slope tends to deflect chips that are drawn into the slot back into the pulp flow (F) and away from the slot. The slope of the lower side surface is inward on the plate of the curved inlet 64. The combination of the curved inlet and horizontal or inclined lower side enhances the ability of the slots 52 to deflect chips into the pulp flow and avoid clogging.

The slots 52 in the plate 50 have an expanding opening with an opening angle (β) that facilitates the movement of liquor (FL) through the slot and the screen plate. In view of the slope of the lower side surface 62, the opening angle (as indicated by the angle of arrow FL) is offset at an upward incline equal to the sum of one half the opening angle (β) and the inclination angle (ω) of the lower side of the slot. The offset upward opening angle results in the liquor flowing (FL) through the slot at a greater upward angle that with a conventional slot. In addition, the upper side 66 of each slot has an angle selected to provide the desired opening angle opening angle (β). For example, an angle of 45 degrees of the cross-section of the upper side 66 and a angle (ω) of 15 degrees for the lower side 62 provides an opening angle opening angle (β) of 30 degrees and an offset angle of 30 degrees, where the offset angle is illustrated by the average flow (FL) direction through the slot.

Figure 10:
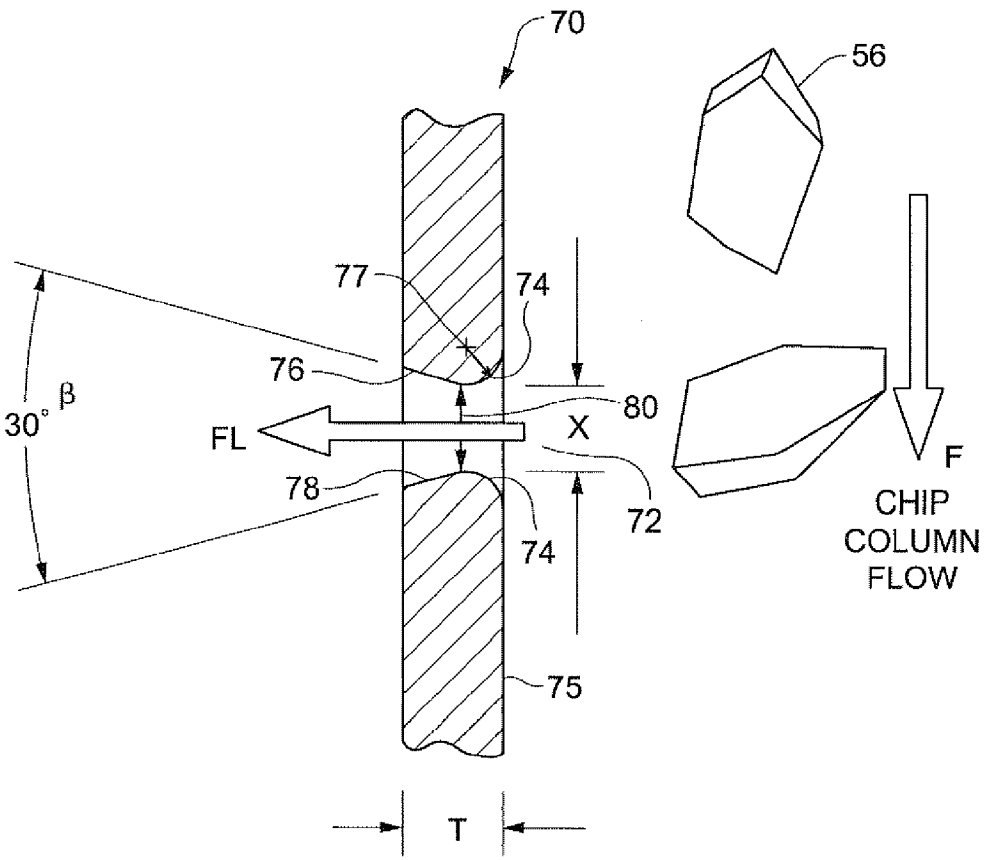
FIG. 10 a cross-sectional side view of the first embodiment of a screen plate, where the view is taken along line 10-10 in FIG. 9.
Figure 9:
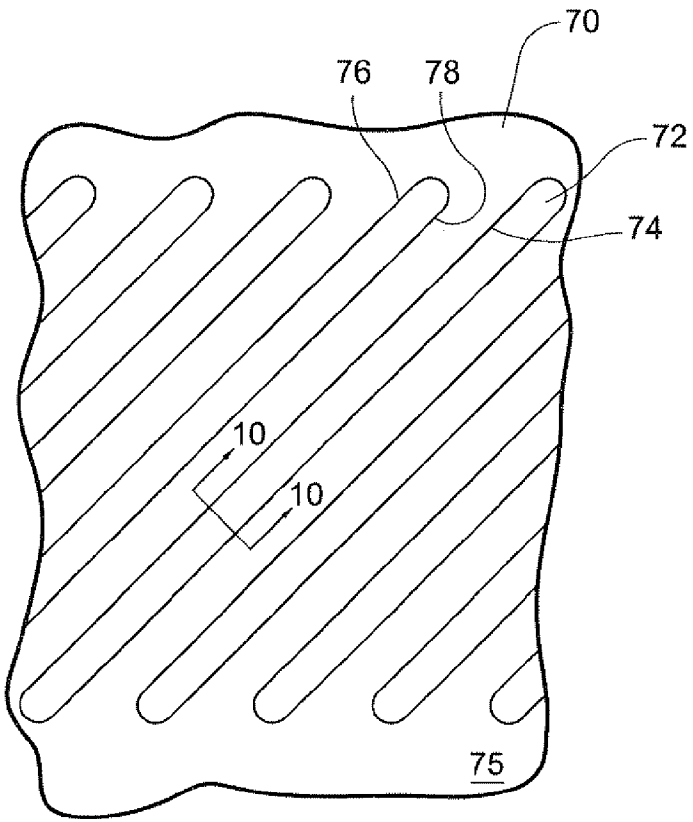
FIG. 9 is a front of a second embodiment of a screen plate having diagonal slots with rounded inlet edges.

FIGS. 9 and 10 are a front and a cross-sectional side views, respectively of a second embodiment of a screen plate 70 having diagonal slots 72 and rounded inlet edges 74. The plate 70 is more suitable for a batch digester in which the pulp slurry is relatively stationary with respect to the plates, but may be applied in a continuous digester. The plate 70 has a curved inlet edge 74 similar to the curved inlet edge 64 shown in FIG. 8. The plate 70 has curved inlets 74 on the upper side wall 76 and lower side wall 78 of the slot, in contrast to a curved inlet edge only on the lower slot sidewall in the plate shown in FIG. 8. The curved inlets 74 on the upper and lower slot sidewalls 78 may be, for example, rounded, angled, sloped, chamfered, beveled, and slanted. The curvature of the slot inlets 74 may be defined by a radius of the curvature. The radius may be, for example, one-third to two-third of the thickness (T) of the plate. In view of the curved inlet, the narrowest region of the slot (X) may be inward of the slot inlet. The narrowest region may be a throat just beyond the inlet and between the inner surface 58 and outer surface 60 of the plate.

The upper and lower slot sidewalls may each be slanted to form an expanding opening angle (β) of thirty degrees. The opening angle for the slots shown in FIGS. 7 to 10 may vary and preferably is in a range of 10 to 30 degrees. The opening angle for slot 72 is not offset is the angle for the slot 52 in FIG. 8. The opening angle for slot 72 is symmetrical about a horizontal line.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A screen plate for a cellulosic material puling vessel, the screen plate comprising:

a plurality of slots extending through the screen plate and having curved inlet corner edges adjacent an inside surface of the screen plate and facing a pulp flow in the pulping vessel, wherein the slots are sufficiently narrow to retain in the vessel substantially all fibers in the pulp flow.

2. The screen plate of claim 1 where the curved inlet corner edges are at least one of rounded, sloped and inclined.

3. The screen plate of claim 1 wherein the curved inlet corner edges having a radius of curvature in a range of one third to two thirds a thickness of the plate.

4. The screen plate of claim 1 wherein the curved inlet corner edges are only on a lower side of each slot, and the lower sides of the slots are each inclined from the inside surface to an outside surface of the plate by an angle of between 5 degrees to 15 degrees.

5. The screen plate of claim 1 wherein the curved inlet corner edges are on upper and lower sides of the slots.

6. The screen plate of claim 1 wherein the slots parallel to the plate form an acute angle with respect to a vertical axis of the vessel.

7. The screen plate of claim 1 wherein the slots have an offset angle perpendicular to the plate at an angle of 15 degrees to 30 degrees with respect to horizontal.

8. The screen plate of claim 1 wherein the slots are arranged in sections of rows on the screen plate, and the sections are arranged in rows and columns on the plate.

9. The screen plate of claim 1 wherein the slots each have a gap between opposite edges and the gap has a width between 3 millimeters (mm) to 9 mm.

10. A screen plate assembly for a continuous digester vessel for pulping cellulosic material, the assembly comprising:

a plurality of screen plates for a cellulosic material puling vessel, each plate having an arc shape in cross-section, and said screen plates being assembled to form an annulus attached to an inside surface of the digester vessel, and each screen plate including a plurality of slots having curved inlet corner edges adjacent an inside surface of the screen plate and facing a pulp flow, wherein the slots are sufficiently narrow to retain in the vessel substantially all fibers in the pulp flow.

11. The screen plate of claim 10 where the curved inlet corner edges are at least one of rounded, sloped and inclined.

12. The screen plate of claim 10 wherein the curved inlet corner edges have a radius of curvature in a range of one third to two thirds a thickness of the plate.

13. The screen plate of claim 10 wherein the curved inlet corner edges are only on a lower side of each slot.

14. The screen plate of claim 10 wherein the curved inlet corner edges are on upper and lower sides of the slots.

15. The screen plate of claim 10 wherein the slots form an acute angle with respect to a vertical line.

16. The screen plate of claim 10 wherein the screen plate has a curvature adapted to fit into a continuous digester vessel.

17. The screen plate of claim 10 wherein the slots are arranged in rows on the screen plate.

18. The screen plate of claim 10 wherein the slots each have a gap between opposite edges and the gap has a width between 3 millimeters (mm) to 9 mm, 19. A screen plate for a cellulosic material pulping vessel, the screen plate allowing liquor to be extracted from the pulping vessel but prevented the extraction of fibrous material, the screen plate comprising:

slots extending through the plates and having curved longitudinal inlet edges which in cross section are curved adjacent an inside surface of the screen plate and facing a pulp flow when installed in the pulping vessel, wherein the slots are sufficiently narrow to retain the vessel substantially all fibers in the pulp flow.

20. The screen plate of claim 19 where the inlet edges which in cross section are curved is at least one of rounded, beveled, and sloped.

21. The screen plate of claim 19 wherein the inlet edges which in cross section are curved have a radius of curvature in a range of one third to two thirds a thickness of the plate.

22. The screen plate of claim 19 wherein the inlet edges which in cross section are curved are only on a lower side of each slot, and the lower sides of the slots preferably each being inclined from the inside surface to an outside surface of the plate, most preferably by an angle of between 5 degrees to 15 degrees.

23. The screen plate of claim 19 wherein the inlet edges which in cross section are curved are on upper and lower sides of the slots.

24. The screen plate of claim 19 wherein the slots parallel to the plate form an acute angle with respect to a vertical axis of the vessel.

25. The screen plate of claim 19 wherein the slots have an offset angle perpendicular to the plate at an angle of 15 degrees to 30 degrees with respect to horizontal.

26. The screen plate of claim 19 wherein the slots are arranged in sections of rows on the screen plate, and the sections are arranged in rows and columns on the plate.

27. The screen plate of claim 19 wherein the slots each have a gap between opposite edges and the gap has a width between 3 millimeters (mm) to 9 mm.

28. A screen plate assembly for a continuous digester vessel for pulping cellulosic material, the assembly comprising:

a plurality of screen plates for a cellulosic material pulping vessel, the screen plates allowing liquor to be extracted from the pulping vessel but prevent the extraction of fibrous material, each plate having an arc shape in cross-section, and said screen plates being each screen plate including slots having which in cross section are curved longitudinal inlet edges adjacent an inside surface of the screen plate and facing a pulp flow.

29. The screen plate assembly of claim 28 where the inlet edges which in cross section are curved is at least one of rounded, beveled and sloped.

30. The screen plate assembly of claim 28 wherein the inlet edges which in cross section are curved having a radius of curvature in a range of one third to two thirds a thickness of the plate.

31. The screen plate assembly of claim 28 wherein the inlet edges which in cross section are curved are only on a lower side of each slot.

32. The screen plate assembly of claim 28 wherein the inlet edges which in cross section are curved on are upper and lower sides of the slots.

33. The screen plate assembly 28 wherein the slots form an acute angle with respect to a vertical line.

34. The screen plate assembly of claim 28 wherein the screen plates have a curvature adapted to fit into a continuous digester vessel.

35. The screen plate assembly of claim 28 wherein the slots are arranged in rows on the screen plates.

36. The screen plate assembly of claim 28 wherein the slots each have a gap between opposite edges and the gap has a width between 3 millimeters (mm) to 9 mm.

* * * * *